US005763819A

United States Patent [19]

Huffman

[11] Patent Number: 5,763,819

[45] Date of Patent: Jun. 9, 1998

[54] OBSTACLE PIERCING FRANGIBLE BULLET

[76] Inventor: James W. Huffman, Rt. 1, Box 1214, Griffin Rd., Prosser, Wash. 99350

[21] Appl. No.: 527,112

[22] Filed: Sep. 12, 1995

[51] Int. Cl.[6] ..... F42B 12/00; F42B 12/34

[52] U.S. Cl. ..... 102/510; 102/501; 102/506; 102/516; 102/517; 102/473; 102/491

[58] Field of Search ..... 102/501, 506–510, 102/514–517, 529, 389, 473, 491, 493; 420/526, 527

[56] References Cited

U.S. PATENT DOCUMENTS

| | | | |
|---|---|---|---|
| 1,252,325 | 1/1918 | Davison | 102/507 |
| 1,447,478 | 3/1923 | Koshollek et al. | 102/510 |
| 3,911,820 | 10/1975 | Canon | 102/38 |
| 3,972,286 | 8/1976 | Canon | 102/38 |
| 4,273,534 | 6/1981 | Seid | 433/90 |
| 4,610,061 | 9/1986 | Halverson | 102/509 |
| 5,185,495 | 2/1993 | Petrovich et al. | 102/510 |
| 5,399,187 | 3/1995 | Mravic et al. | 102/506 |
| 5,535,678 | 7/1996 | Brown | 102/501 |

OTHER PUBLICATIONS

1994 Annual Edition of Guns & Ammo, by Ed Sanow "21st Century Defense Loads", pp. 19–25.

Handguns Aug. 1995, vol. 9, No. 8, by Ed Sanow "Rhino–Ammo—The Inside Story", pp. 42–46,88& 89.

"The Condensed Chemical Dictionary", Eighth Edition 1971, p. 39.

*Primary Examiner*—Harold J. Tudor

*Attorney, Agent, or Firm*—Floyd E. Ivey

[57] ABSTRACT

The present invention relates generally to small arms bullets and relates in particular to frangible bullets and ordinance which fragments following penetration of a variety of obstacles prior to encountering the intended target zone. The disclosure relates specifically to small arms bullets which have a high likelihood of fragmentation after target zone penetration causing a significant crush cavity following passage through obstacles including clothing, glass, building materials and other structures. The disclosed bullet design is produced in a simple and inexpensive process, provides high accuracy and fragmentation and penetration in a 5 to 15 inch target zone, at either sonic or subsonic velocities, following penetration of shielding obstacles. The bullet disclosed is of a weight and design which will permit operation at sonic or subsonic velocities, without jamming, in civilian and military small arms including automatic weapons. The disclosure also applies to military ordinance and armor piercing munitions where fragmentation following obstacle penetration is intended.

7 Claims, 1 Drawing Sheet

OBSTACLE PIERCING FRANGIBLE BULLET

FIELD OF THE INVENTION

The present invention relates generally to small arms bullets and relates in particular to frangible bullets and ordinance which fragments following penetration of a variety of obstacles prior to encountering the intended target zone. The disclosure relates specifically to small arms bullets which have a high likelihood of fragmentation after target zone penetration causing a significant crush cavity following passage through obstacles including clothing, glass, building materials and other structures.

BACKGROUND OF THE INVENTION

Certain military, police and civilian hostile encounters necessitate use of a small arms bullet which will have a high probability of incapacitating with an initial shot. Under some circumstances a perpetrator will be unusually aggressive and so stimulated by adrenalin or other stimulants or intoxicants as to be unusually formidable. Such opponents may be scared or ready for fight or flight and as such are difficult to incapacitate prior to their having the opportunity to inflict additional damage. With conventional hollowpoint in standard small arms calibers (357 mag., 45 and other), there have been numerous instances where a hostile perpetrator will continue to function after being shot several times. Such individuals may sustain fatal injury but are able to continue their offensive functioning to the detriment of additional human life. Particular Federal Police Agencies have sought a bullet which would have a high probability of incapacitating such a perpetrator with a single shot which delivers deep incapacitating penetration.

The evolution of bullets designed to incapacitate with an initial shot would include progressively the hollowpoint, prefragmented and frangible designs. The 1994 Annual Edition 11 of Guns & Ammo, Petersen Publishing Company, pages 19–25, summarizes, in part, the evolution. More recent developments are reviewed in Handguns August 1995, Volume 9, Number 8, Petersen Publishing Company, pages 42–46, 88 and 89. Background pertinent to evolution and development of predecessors to the disclosure herein is now noted:

(1) The aluminum jacketed Winchester Silvertip™ was introduced in 1980 as an improvement over then existing hollowpoint bullets. The serrated aluminum jacket was understood to enable bullets to expand more reliably and to larger diameters than copper-jacketed bullets. The design intent was to achieve rapid expansion and avoid overpenetration thereby reducing risk to bystanders. The United States Secret Service reportedly used a 9 mm 115 grain version of this bullet until the early 1990's when it commenced use of a +P+ version. This bullet is understood to have performed to design expectations when employed by the FBI in a Miami, Fla. confrontation where the assailant continued a deadly offense after being shot by police authorities. This bullet was considered a standard for hollowpoint handgun ammunition from 1980 through 1988.

(2) The Hydra-Shok™, designed in the 1970's, is a pointed or rounded tip hollowpoint with a lead post swaged in the center of the hollowpoint cavity. The center post is understood to amplify and focus fluid pressure and act as an accuracy enhancing forward and centerline balance shaft. Accuracy is reported as a problem related to large-cavity hollowpoints. Federal Cartridge is reported to have assumed production rights of this bullet in 1987 and to have modified the design retaining the hollowpoint with swaged center post concept. These design changes are understood to have led law enforcement agencies to consider this bullet as a standard for comparison of bullet performance, thereby replacing the Winchester Silvertip™. The FBI is understood to have conducted testing of these bullets with and without the swaged center post. Reported test results for external and terminal ballistics, believed to have been conducted with 10% ballistic gelatin, indicated that the unmodified bullet demonstrated superior performance, after penetration of glass, in size of crush cavities, accuracy, expansion and penetration in the 12-to-18-inch range.

(3) The Nyclad™ bullet was considered a solution to stopping-power problems of poor expansion reliability in lower-velocity calibers. This bullet is now produced by Federal Cartridge. The design was changed making the nylon coating thinner (for improved accuracy), reduced the tin and antimony content (to improve the reliability of expansion), and changed the feed profiles and hollowpoint openings on all calibers. These changes were reported to produce reliable expansion, high weight retention and adequate penetration. The Nyclad™ is understood to expand more reliably at the lowest velocities than copper jacketed hollowpoint bullets and to expand more readily than other lead hollowpoints which must use higher percentages of antimony (used to harden lead and prevent bore fouling). The bullet was rated highly in .38 Special (non-+P, 125-grain) and 9 mm (non-+P, 124 grain calibers in testing in calibrated ordinance gelatin and in actual police shooting results.

(4) The Glaser Safety Slug™ was developed by Jack Y. Canon, in approximately 1969 and was believed to be the first frangible prefragmented personal defense bullet. This bullet has a thin serrated copper jacket filled with number 12 or number 6 birdshot and sealed with a polymer nose cap. The bullet is reported to rupture on impact releasing birdshot and creating a wound resembling that from a 0.410 bore contact shotgun blast. The bullet is understood to have been used by the U.S. Customs Service "Sky Marshals" as the bullet least likely to overpenetrate and cause a bystander hazard; it was also considered the least likely to ricochet or puncture an aircraft fuselage. The bullet has been considered most likely to expand and transfer energy. The bullet was once filed with liquid Teflon™ which was shown to both slow pellet dispersion in a target and reduce velocity (due to added weight). The bullet has changed from a flatnose profile to a roundnose profile in 1987. This profile change increased the feed reliability of the bullet in automatic pistols. An additional change was the use of compressed birdshot in 1991. The compressed load was reported to produce deeper pellet penetration, greater internal dispersion and improved accuracy. The use of number 12 birdshot was deemed to reduce ricochet hazard while number 6 birdshot developed deeper penetration. A characteristic of this bullet is the maximum penetration of 5 to 7 inches in calibrated ordinance gelatin. The bullet was tested in the Strasbourg animal tests and was rated first in .38 Special +P; second overall in .380 ACP, .40 S&W and .45 ACP; and third in 9 mm, 10 mm and 0.347 Magnum.

Frangible bullets of this type design are disclosed in U.S. Pat. Nos. 3,911,820 and 3,972,286 to Jack Y. Canon which are disclosed in the associated Information Disclosure Statement.

(5) The MagSafe™ frangible and prefragmented defensive bullet uses a serrated copper alloy jacket. Compressed or fused number 4 or number 2 birdshot, embedded in marine epoxy, constitutes the prefragmented core of this bullet. The bullet fragments on impact, produces a fewer number of larger-diameter crush cavities than the Glaser Safety Slug™, and penetrates between 11 and 13 inches. The bullet is reported to remain intact when penetrating objects (including building materials and auto panels) intermediate to the target with release of the prefragmented load upon impact with ordnance gelatin.

(6) The Hornady Manufacturing™ XTP and XTP-HP are understood to have been designed in response to FBI needs following the hollowpoint experience wherein the perpetrator was able to continue a damaging offense after having been shot. It is understood that the FBI had set up a series of eight performance tests involving bare gelatin and also gelatin behind heavy clothes, auto glass, sheet metal and building materials. The tests were intended for ordinance for use by special agents and not necessarily for police use in general. The test methodology developed is reported to have been the controlling aspect of bullet design since 1987. The Hornady XTP™ and XTP-HP™ are understood to have been designed to suppress bullet expansion and totally avoid fragmentation. If is believed that the rounds perform as designed producing extremely deep penetration with little expansion. The XTP-HP™ is understood to perform well when operated at very high velocities. The 9 mm 124-grain XTP™ loaded to +P+ velocities was the best overall 9 mm load in tests conducted by the Indianapolis Police. Tests involving .40 S&W high-speed 155-grain XTP™ operated satisfactorily at velocities which would be expected to fragment other bullet designs. The XTP™, for a hollowpoint design, is also understood to perform well in match-grade accuracy. It is also reported that the conical feed profile of the XTP™ assists consistent feed reliability, (7) The Winchester™ Black Talon™ (named the Supreme Expansion Talon SXT™) is understood to utilize a copper-zinc jacket designed to encourage the jacket to peel back into segments or petals and to eliminate separation of the jacket petals after expansion. The jacket petal formation increases tissue damage along the bullet path. The design is intended to increase stopping power by causing tissue damage outside the normal crush zone including crushing, stretching and cutting mechanisms. The "talon" or petal formation is produced by a combination of alloy (using a higher than normal copper content in the copper-zinc jacket) and a reverse-taper jacket design formed with a special selective heat-treat process. The bullet appears to be a copper-base FMJ bullet just prior to the last pierce-and-form operation. The jacket is thicker near the hollowpoint. The hollowpoint opening is punched into the bullet. The reverse taper jacket increases production control of "heel bulge" in the final forming operation. It is understood that square-based constant-diameter bullets have enhanced accuracy.

The Black Talon™ heat-treat is intended to soften the jacket near the hollowpoint cavity to permit the jacket to fold back easily. The middle of the jacket is partially annealed and the bullet shank and base are left full work-hardened. The jacket serration operation includes a 90-degree bend that forms the base of the talon for reinforcement. When the jacket petals peel back, they remain exposed even after impact with bone. The bullet is reported to penetrate deeper than ordinary JHP bullets before expansion commences.

It is reported that the Black Talon™ expands more rapidly, once expansion begins, than a conventional JHP. This permits a higher penetrating velocity as with a subsonic hollowpoint and a large recovered diameter and temporary cavity as with a rapidly expanding Silvertip™.

(8) The Eldorado Starfire™ is understood to utilize a fluted hollowpoint cavity, in lieu of center post, in addressing bullet expansion. The Starfire™ design includes sharp edges and a flat bullet profile. The sharp edges are provided by the ribs inside the hollowpoint cavity. The ribs and flutes roll outward during expansion to engage tissue and assist in penetration. The ribs and flutes act as wedges to force the cavity walls open. Fluid pressure enters the hollowpoint cavity and is split by the wedge-shaped ribs. The pressure is redirected into the flutes that line the cavity wall. Expansion pressure is focused on the cavity wall which opens along five lines. The hollowpoint cavity is approximately as deep as the bullet is long and has the ability to expand to the bullet base. The bullet does not fragment after expansion nor does it fragment after high-velocity impacts. The bullet continues to expand to larger recovered diameters. Large bullet diameters typically limit the depth of penetration. It is believed that the sharp edges of the ribs and the high retained weight tend to increase the depth of penetration. In the Strasbourg tests the Starfire™ outperformed conventional JHP bullets of the same weight and velocity. Ordnance gelatin tests indicate the 9 mm 124-grain Starfire™ to be an effective police and defensive load.

(9) The CCI-Clount Totally Metal Jacketed™ (TMJ) bullet was introduced in 1988 and was followed by the CCI Plated Hollow Point™ (PHP) which used the TMJ blank. The copper jackets of these bullets, solid and hollowpoint respectively, were applied through electroplating onto a lead core. Advantages of copper-plated bullets over conventional swaged jackets include a core which is precluded from rotation or separation from the jacket thus increasing accuracy. The plated jacket also increases weight retention, especially for high-velocity impacts with tissue or impact with a hard object. The fully encased bullet also reduces airborne lead contamination.

CCI changed design parameters for the PHP line in 1993, introducing the Gold Dot™, to include eight serrations. The bullets are reswaged after plating for uniform diameters and square bases to increase accuracy. The bullets terminate expansion prior to shearing off the mushroom formation. The Gold Dot™ design is intended to avoid fragmentation, from shearing of the mushroom, in the high-velocity loads and where light bullet weights and rapid expansion may limit penetration.

(10) The Remington™ Golden Saber HPJ™ demonstrates divergence from past jacket cladding technology, where gilding metal consisted of 95% copper and 5% zinc, using a jacket made from cartridge brass of 70% copper and 30% zinc forming a stiffer jacket. This slows the rate of expansion and reduces fragmentation. The stiffer jacket is complemented by a larger hollowpoint cavity opening which is the same diameter as the jacket opening. The cavity is relatively shallow. Early expansion forces are directed against the stiff jacket and not the lead core. The jacket peels back but, because of the stiffness, does not fold back against the bullet shank holding, instead, a large diameter. Expansion forces focus on the bullet core with a shallow hollowpoint cavity. Shallow cavities are believed to produce minimum core expansion and maximum weight retention. The Golden Sabre™ design is thought to increase tissue damage from the jacket structure rather than relying on damage from the core. The core maintains its weight for deeper penetration. The jacket expands to a large recovered diameter for the crushing action of the bullet. The jacket remains away from the bullet core even after impact with bone. Initial gelatin and animal tests indicate the HPJ™ to have improved hollowpoint performance in comparison with prior Remington™ auto pistol bullet hollowpoint technology.

(11) The Signature Products Corp. Rhino-Ammo™, Black Rhino™ or Razor-Ammo™ was introduced in late 1994. It is understood that the Rhino-Ammo™ is formed from a CCI-Speer hollowpoint bullet. The .45 ACP caliber is based on the Speer 225-grain JHP. The bullet is fixed in a lathe and the hollowpoint cavity drilled down to approximately the bullet base and to a diameter approximately as large as the jacket opening. Thereafter the hollowed-out bullet is put in a fluid energy mill, tumbled in media that removes more lead, smooths out the cavity walls and polishes the bullet jacket. In original loads a polymer was poured into the drilled-out cavity. It was determined that this process significantly reduced projectile accuracy being too rear heavy to be stable in flight. Weight was added forward of the center of gravity leading to a second-generation load which managed accuracy of groups into five inches at 50 feet. The polymer in the second-generation bullets was poured into the cavity in two phases: the first phase filled the cavity leaving space for seven number 4 birdshot pellets and room for final sealing polymer; following the curing of the initial polymer, birdshot was added and sealed. This second generation of bullet, in the .45 ACP caliber, it is understood, weighed 125 grains while the 9 mm version weighed 98 grains. Blended canister-grade powder was used to achieve a desired time-pressure curve. The impact, with this design, results in the jacket peeling back, the release of plastic core fragments and then release of the birdshot pellets. It is understood that 1,500 to 1,600 fps velocity loads have been independently tested, in both .45 ACP and 9 mm, in calibrated, 10% gelatin revealing 5.3-inch cavity diameter and penetration depth of 7.5 inches.

The Rhino-Ammo™ was compared, in .45 ACP and 9 mm loads, with the Glaser Safety Slug™ and the MagSafe™. The comparison indicated that the bullet construction was markedly different from the Glaser Safety Slug™ and markedly similar to the MagSafe™. The Rhino-Ammo™ or Razor-Ammo™ was found to instantly fragment in 10% gelatin even after penetration of heavy clothes. The bullet construction has no hollowpoint cavity. The birdshot pellets at the nose of the bullet penetrated independently of the main stretch cavity as did lead fragments from the lead lining from the lead core. There was no finding of independent penetration from the polymer fragments after the polymer core fragmented. The polymer fragments were found to line the inside of the temporary cavity caused by the bullet breakup. The polymer fragments were hard and sharp but lacked sufficient weight to cause independent penetration.

Rhino-Ammo™ or Razor-Ammo™ is understood to have been compared with similar fragmenting loads and with conventional hollowpoint loads. In 9 mm and .45 ACP calibers the bullet was deemed to be as effective as the best frangible load in the caliber and more effective than the best hollowpoint producing more stopping power than subsonic and non-hollowpoint loads.

Tests have been conducted regarding the probability of particular bullets or loads in delivering an impact of a nature of likely terminating activity of a perpetrator with a single shot. Marshall and others have written about the Strasbourg tests where the subjects were goats. Glaser™ and Magsafe™ prefragmented rounds, consisting of bird shot placed in a jacket covered with epoxy, were judged to have the impact with the highest likelihood of terminating activity with a single shot. The impact of the prefragmented bullet had the highest likelihood of causing almost instantaneous disabling impact. The existing prefragmented bullets, consisting of bird shot in epoxy, have weights lower than a standard police or military small arms bullet. The lower weight contributes to weapon malfunction. The bird shot, being smooth and round, causes a less significant crush cavity than a design with fragmentation.

SUMMARY OF THE INVENTION

In accordance with the present invention, a bullet design is disclosed which relates specifically to small arms bullets which have a high likelihood of inflicting a significant crush cavity within the target zone with a single shot following passage through obstacles including clothing, glass, building materials and other structures. The disclosed bullet design is produced in a simple and inexpensive process, provides high accuracy and produces a significant crush cavity through bullet core fragmentation with penetration of 5 to 15 inches in 10% ballistic gelatin, at either sonic or subsonic velocities, following penetration of shielding obstacles. The bullet disclosed is of a weight and design which will permit operation at sonic or subsonic velocities, without jamming, in civilian and military small arms including automatic weapons. The disclosure also applies to military ordinance and armor piercing munitions where fragmentation following obstacle penetration is intended.

The present invention comprises an improvement to known solid, hollowpoint, prefragmented and frangible bullets and other munitions intended to inflict significant crush cavities with a minimum of shots. The disclosure demonstrates a bullet design which is produced in a simple and inexpensive process; which provides high accuracy; which will penetrate shielding materials prior to fragmentation and which will create a significant crush cavity when used in small arms caliber weapons. The disclosure also applies to military cannon and other large artillery rounds including armor piercing rounds.

The invention herein disclosed addresses particular bullet design, production and utilization issues alluded to in the foregoing Background of the Invention and in literature and practices which are familiar to individuals and organizations professionally associated with firearms. The issues addressed and resolved by this disclosure relate to the utilization of small arms ammunition in circumstances requiring rapid immobilization and include: 1. delayed or limited expansion and fragmentation leading to overpenetration and risk to bystanders; 2. problems of poor fragmentation reliability in lower-velocity calibers; 3. unsatisfactory operation at velocities which would be expected to fragment most bullet designs; 4. bullet and or jacket formation permitting overpenetration or reduced crush cavity along the bullet path; 5. decreased stopping power caused by decreased damage within the normal crush zone including inadequate crushing, stretching and cutting mechanisms; 6. light bullet weights and rapid expansion and or fragmentation limiting penetration; 7. complex and expensive bullet manufacturing processes or steps including filling thin serrated copper jackets with birdshot and polymer or other compounds, compressing or fusing birdshot embedded in epoxy, producing reverse-taper jackets requiring special selective heat-treat processes, electroplating copper jackets onto lead core bullets, forming hollowpoint cavity using a lathe and drilling process followed by tumbling of the hollowed-out bullet in a fluid energy mill prior to filling the cavity with polymer and birdshot; 8. bullet shapes or feed profiles which interfere or impede automatic feed mechanisms; and 9. reduced accuracy related to large-cavity hollowpoints or unpredictable centers of gravity caused by bullets composed in part of birdshot. Those familiar with the art will recognize additional issues of concern which are eliminated or lessened by the present invention.

Alloy Composition

The preferred embodiment of the obstacle piercing frangible bullet is composed of a bullet core of metals and/or alloys which are brittle or frangible and which fragment, under conditions described herein, following impact with a target. A principal characteristic of importance is the frangibility of the metal or alloy which in turn leads to the fragmentation property which is the focus of this disclosure. The alloys of foremost consideration herein are derived from and related to dental alloys and amalgams. The particular alloy or amalgam initially considered is a standard dental alloy made of mercury, silver, tin, copper and zinc (hereafter identified as Alloy A). Dental amalgams are also found which contain the following in addition to mercury, silver, tin and copper: palladium, gold, platinum, indium as in U.S. Pat. No. 5,242,305 to O'Brien; zinc, indium, palladium, platinum, gold, cobalt, nickel, germanium and selenium as in U.S. Pat. No. 4,758,274 to Kumei Yasuhiro and others; combinations of alloys as in U.S. Pat. No. 3,997,328 to Greener; combinations of alloys including an alloying constituent individually selected from the group consisting of 5% cadmium, 5%–50% zinc, 5%–50% aluminum, copper in an amount to provide a silver-to-copper ration of about 2.6:1 as in U.S. Pat. No. 3,980,472 to Asgar and Reichman.

It is apparent that many dental alloys or amalgams exist. A dental amalgam composed, by percentage by weight, of 50% mercury, 26% silver, 23% tin and 1% copper demonstrates the brittleness and frangibility resulting in fragmentation characteristics of particular importance to this disclosure. It is believed that dental amalgams or alloys universally demonstrate this fragmentation characteristic. Dental amalgams prepared from the ranges of elements set out in the following table as Alloys A, B, C, D and E demonstrates fragmentation characteristics which likewise support this disclosure.

The silver component of these amalgams poses a particular expense which would be of prominent interest in manufacturing. The replacement of silver with cadmium or cadmium and bismuth reduces the expense and yields, as well, the fragmentation characteristic which is sought by this disclosure. The following table suggests ranges of elements in amalgams of Alloy B, C and D which provide the intended fragmentation characteristic. Other amalgams and alloys from the group of cadmium, bisumth, and antimony, will also produce the intended fragmentation characteristic. However, it is important to note that other amalgams and alloys will provide the requisite brittleness and will suffice in performance to deliver fragmentation of a nature which will accomplish the result intended by this disclosure.

Alloy A, an amalgam, disclosed for use in the present invention, has been commonly utilized for decades for dental restorations, without adverse results, with direct human body contact. There has been no evidence developed of clinical hazard to humans from Alloy A.

The composition of Alloys A, B, C, D and E, element percentages by weight, are as follows:

| | Alloy A | Alloy B | Alloy C | Alloy D | Alloy E |
|---|---|---|---|---|---|
| Mercury | 40%–60% | 55%–70% | 55%–65% | 55%–65% | 60%–70% |
| Silver | 25%–40% | 0 | 0 | 0 | 0 |
| Cadmium | 0 | 15%–45% | 10%–30% | 15%–30 | 25%–30% |
| Bismuth | 0 | 0 | 10%–30$ | 15%–30% | 0 |
| Tin | 15%–25% | 0–25% | 0 | 0 | 0 |
| Copper | 0–5% | 0–2% | 5%–15% | 5%–15% | 5%–10% |
| Zinc | 0–2% | 0–1% | 0–1% | 0–1% | 0–1% |

An ideal amalgam for Alloy A consists of the mixture by percentages by weight of Mercury 50%, Silver 26%, Tin 23% and Copper 1%. An ideal amalgam for Alloy B consists of the mixture by percentages by weight of Mercury 66%, Cadmium 20%, Tin 12.9% and Copper 0.1%.

The Alloys noted above exhibit requisite brittleness and are ranked in decreasing brittleness as follows: Alloy A, D, E, C and B with Alloy A demonstrating the greatest brittleness. A ranking of the alloys for hardness follows the same pattern as found in ranking for brittleness.

The metals used in tests associated with this disclosure and in dental amalgams are in powder form of 100 mesh or finer and are 99% pure. The mercury was triple distilled at 99.9% pure. The elements used for bullet production are not expected to require purity to this extent while producing the required fragmentation characteristic.

Bullet Manufacturing Process

Alloy A has been in use for approximately one hundred years for dental purposes. The amalgamation alloy formation process utilized in dentists' offices is well known. The mixing process does not require furnaces or the need for any heating. The bullet formation, from the alloys plastic state, does not require presses or other devices to exert extraordinary forces to deform the jacket or bullets. Precision production is easily attained by bullet formation with these alloys in their plastic state. There is no need to attend to hardening and softening processes as done with lead, by use of minute quantities of antimony and zinc.

The silver content of Alloy A poses an expense factor which can be addressed through use of Alloy B or other alloys suggested. Other alloy combinations of elements can significantly reduce the expense of manufacturing the alloy.

These alloys, when used as dental amalgams, are formed by mixing mercury, in its liquid state, with the remaining elements in powder form. Mixing may be accomplished in a twin screw or auger device or any of a variety of mixing devices or by a variety of mixing means. Dental amalgams are commonly contained, prior to mixing, in a cylinder divided into two compartments by a diaphragm. One cylinder compartment contains mercury while the second contains a powdered mixture of silver, copper, tin, zinc and others as previously discussed. The mixing means commonly found in the dentist's office is a shaker. The vibration or shaking of the cylinder breaks the diaphragm allowing the amalgamation of mercury and the components contained in the second compartment. The alloys set out herein may similarly be mixed.

Formation of the amalgam of Alloy A, B, C, D and E, may be accomplished, without the addition of heat, between a temperature range of from approximately 12° F. to approximately 130° F. The alloy assumes a plastic state immediately upon completion of mixing and can be forced into a mold, for solid designs, or a mold or jacket allowing a hollowpoint configuration to be stamped, with very little pressure, into the nose of the bullet. The forming or stamping of the hollowpoint, in virtually any configuration or design, is easily accomplished with a simply shaped die which could be easily inserted into the bullet nose or hollowpoint opening of a jacket by a hydraulic ram or other device, including die insertion by hand, to push down into or displace the alloy, in its plastic state, in a mould or jacket. The plastic state alloy is easily molded, manipulated, and formed. Hence any press or die insertion mechanism would not require significant mechanical advantage. A die would not need to be made of tool steel or carbide and wouldn't require cutting properties inasmuch as the hollowpoint operation is merely one of displacing or compressing the alloy in its plastic state. Following removal of the die the alloy will proceed to set up or cure to its full strength. A bullet formed absent a preformed jacket can have a jacket applied via electroplating.

The alloy setting time can be varied by the selection of the amount of the elements present in the alloy, by control of the temperature of the process and by the length of time of mixing. The time for cure or set up of the alloy in its plastic or mixed stage decreases with increased alloy mix temperature. The cure or set up time can be manipulated to permit the alloys to remain in a plastic state for time sufficient to permit hollowpoint formation and other molding operations with little pressure or mechanical advantage. Extended plastic state times can be achieved. The cure or set up time can also be reduced to as little as 2 minutes. Choice of alloy by element weights can be made which will allow the alloy to achieve any shape necessary to pass through injection nozzles. The alloy mixing is routinely accomplished in dentist's offices and applied, in their plastic states, in the filling of cavities.

Alloys A, B and C can be expected to remain in their plastic state for up to 15 minutes following alloy mixing, under appropriate temperature and mixing conditions. Alloys D and E remain in the plastic state for a much shorter time than expected for Alloys A, B and C resulting in a short setup time.

Following mixing, the alloy would be injected, while in the plastic stage, into a jacket with a hollowpoint design stamped depending on the type of fragmentation desired. The management of production of type of bullet, whether solid or hollowpoint, is readily accomplished while the alloys are in their plastic state.

Bullet Operation

The formation of a hollowpoint in a bullet of this alloy will produce a bullet with hollowpoint operational characteristics with fragmentation following impact and upon penetration. Bullets of these alloys without a hollowpoint will perform like a solid round. Solid round nose bullets and hollowpoints of these alloys, of 9 mm and .40 caliber, have penetrated one-sixteenth inch sheet steel in tests (hollowpoints used in these tests penetrated the sheet steel and then fragmented in water contained behind the steel barrier). In most hollowpoint tests, Sierra Jacket Hollowpoint bullets were used as the source of the jacket with bullet core contents melted and removed and with jackets then filled with the herein disclosed alloys. The Sierra Jackets were filled to form 115 grain 9 mm, 165 grain .40 S&W, and 100 grain .380 ACP JHP bullets. The bullet weight includes the weight of the jacket and alloy core.

The alloys proposed for this use offer the following characteristics: 1. they have approximately the same density as lead; 2. they are homogenous; 3. the components with the exception of mercury are available in powders of 100 mesh or finer and are easily stored and combined; 4. the combination of the alloy components is simply accomplished by mixing; 5. the alloys readily adapt to irregular shapes at room temperatures for approximately one to fifteen minutes following mixing thus lending to ease in formation of bullets without jackets or in filling standard hollowpoint bullet jackets; 6. the alloy, with or without jacket, readily receives a variety of dies for the forming of hollowpoint cavities of any shape and depth; 7. they are relatively hard; and 8. they are frangible at low and high velocities producing sharp fragment particles of 0.01" up to the bullet diameter.

In bullets formed with the disclosed alloys, fragmentation can be controlled by a combination of the velocity of the bullet, hollowpoint diameter, depth and shape and choice of alloy. Alloy C fragments into smaller pieces than Alloys A or B. Alloy D is harder and produces larger fragments than Alloys A or B. The larger diameter deeper hollowpoint cavities will increase the number of fragments while producing smaller fragments and providing less penetration in all alloys. Inversely, smaller diameter, shallower hollowpoint cavities will produce fewer fragments of larger size resulting in deeper penetration. In tests, the fragmentation of the bullet core was noted to frequently terminate at the bottom of the hollowpoint cavity leaving intact the portion of the bullet core essentially between the bottom of the hollowpoint cavity and the bullet base. Fragmentation is noted to be increased when a lead post is swaged in the center of the hollowpoint cavity.

Fragmentation occurs at velocities from 400 feet per second or lower to 1,400 feet per second and higher. Small arms bullets utilizing these alloys will operate at low safe pressures and will not require a change in gun powder loads to achieve desirable performance characteristics. Bullets of these alloys will fragment in water or 10% or 20% ballistic gelatin after piercing various barriers including building materials such as sheetrock, wood, glass, and sheetmetal and clothing or combinations of these and other materials.

Bullet penetration in 10% ballistic gelatin can be moderate to very deep, depending on the alloy used and the hollowpoint design, with standard bullet weights, powder loads and pressures (Speer, Reloading Rifle & Pistol Manual (Number 12), copyright Blount, Inc. Sporting Equipment Division, P. O. Box 856, Lewiston, Id., 83501, 1994.) Alloys A, B and E produce penetration of 4" to 15". Tests of Alloy C produced penetration of 7"=8" while Alloy D penetration is expected to be up to 12". However, penetration and fragmentation can be manipulated by selection of the hollowpoint cavity profile.

Bullets manufactured from the alloys disclosed will function below the sonic level resulting in fragmentation and production of significant crush cavity and penetration at a velocity of 1000 feet per second. Testing also demonstrates satisfactory operation at muzzle velocities up to 1300 feet per second.

In tests an 87 grain bullet composed of these alloys was fired at a velocity of at least 1300 feet per second. Penetration was not as deep as with heavier bullets however a large hollowpoint was employed resulting in significant fragmentation. The large hollowpoint was used mainly to remove some of the material to lower the bullet weight. The same Sierra jacket was used throughout all experiments. The jacket was commercial and was unmodified with existing serrations left intact and unmodified with the exception of certain tests. In testing penetration through 2" wood and fabric barriers, serrations were added to jackets using a file. Deeper serrations insured fragmentation after penetration.

Bullets produced from these alloys will fragment at standard handguns velocities. All experimentation was done with 115 grain 9 mm, 165 grain .40 S&W and 100 grain 380 ACP with Sierra Hollowpoint Jackets. Fragmentation was demonstrated to occur below the sonic speed (below approximately 1180 feet per second). Fragmentation also occurs above 1250 feet per second.

These alloys produce a homogenous mass causing the bullet to have the same density throughout. This characteristic increases accuracy and reduces likelihood of tumbling. The Magsafe™ rounds and the Glaser Safety Slug™ rounds utilize a jacket filled with bird shot. In some of the Magsafe™ rounds the bird shot is compressed resulting in distorted shot. The shot is then sealed with epoxies. The birdshot composition precludes the forming of a uniform density and hence a center of gravity along the longitudinal centerline of the bullet. The birdshot bullets tend to be less accurate than conventional bullets.

The birdshot design frangible bullets weighing less than standard bullets require extremely high velocities to function well. The low density of the birdshot designs result in bullets which weigh approximately one-half as much as a lead filled jacket. The density of these alloys approximates that of lead. The comparison of densities of these alloys and lead is demonstrated as follows: using identical jackets and hollowpoint designs, a lead bullet will weigh 115 grains while a bullet consisting of these alloys will weigh 110 grains.

The Magsafe and Glaser Safety rounds are composed of bird shot sealed in a jacket with epoxy. The bird shot in certain Magsafe rounds is compressed into the jacket. The compressed shot structure is inherently limited in producing a uniform center of gravity. Compression causes the shot to be distorted thus eliminating uniformity of density and precluding a center of gravity along the bullet's centerline. This limitation contributes to tumbling and inaccuracy. The construction results in low bullet weight thus requiring extremely high muzzle velocities to effect reasonable functioning in most small arms. The weight of bullets composed of bird shot is generally half of that which would be experienced if the jacket was filled with lead. Such construction does not function as well as commercial ammunition existing today in particular in automatic weapons. Recent design changes are reported to have increased accuracy and reliability in automatic weapon use. These bullets remain unreliable, in automatic weapon use, at low velocities.

The round nose solid and the small diameter hollowpoint designs will operate in revolvers and semi-automatics and full automatic weapons. The bullet should function at least as well as the commercial ammunition that exists today in any automatic, revolver or any automatic weapon.

The very high velocities of the Magsafe™ and Glaser™ bullets creates additional obstacles. Super sonic velocities cause a sonic crack when bullets with such velocities are fired with this occurring even in a suppressed weapon. Marked muzzle blast results. The high velocity design of the Glaser and Magsafe bullets compensates for the low bullet weight. This low weight/high velocity design problem is compounded when a bullet designed for a 4 inch barrel pistol is used in a pistol with a 2 inch barrel. The bullet when used in the 4 inch barrel will reach 1200 ft/sec but will not achieve a similar velocity if used in a 2 inch barrel. A normal hollowpoint bullet, when shot under such circumstance, will fail to expand. However, many current hollowpoint designs do not function well or at all below the speed of sound of approximately 1180 feet per second. Recent design changes are reported to have improved regular hollowpoint performance at velocities of 950 feet per second. The Magsafe and Glaser bullets do not penetrate or fragment satisfactorily at low velocities continuing to require velocities of approximately 1400–1600 feet per second.

The Nature of Penetration of 10% Ballistic Gelatin

Extensive tests in water and 10% ballistic gelatin demonstrated that an extremely small hollowpoint allows deeper penetration while producing fewer fragments of larger size. Conversely, the larger the diameter and the deeper the hollowpoint the greater the number of fragments with more fragments of a smaller size.

The crush cavity in the ballistic gelatin was on average 4 inches in diameter at its maximum dimension. The fragments that are formed are jagged, and caused extensive damage within the penetration and crush cavity. Damage to tissue would be extensive. Damage within the crush cavity is opened up more rapidly, by the extensive fragment lacerations, than with rounds of other designs. It was noted that bullet fragmentation commenced earlier in the penetration in ballistic gelatin and water than occurred with rounds of other design.

These alloys should be more efficient due to the brittleness and abrupt fracturing, following penetration, without metal flowing. Lead alloys, in conventional hollowpoints, lose energy in the form of heat inasmuch as lead flows as deformation occurs thereby producing heat. The alloys disclosed herein will flow less, with deformation, as a result of the fragmentation. Energy otherwise lost through generation of heat in conventional bullets is expended, in the bullets disclosed here, through the fragmentation and penetration.

Military and Munitions Uses

These alloys could be used as an armor piercing round and for other military applications with the addition of the appropriate penetrator. Armor piercing penetrators, including tungsten penetrators, could be inserted in rounds while alloys are still in their plastic state. Any semi-solid or solid substance may be so inserted during the plastic state. In tests with a 30 caliber rifle at approximately 3,000 feet per second, rounds pierced one-sixteenth inch steel plate with fragments cutting a 4" diameter hole in steel mesh located 6" behind the steel plate.

Manufacturing processes for military applications will be simplified using these alloys. The typical incendiary armor piercing round requires the drilling of a hole in carbide steel like material. The armor piercing portion must be machined to exact tolerances. This requires one entirely separate step. Cutting armor piercing material is difficult. The incendiary device or tracer has to be placed in the base. The machining and drilling processes are time consuming, expensive, and labor intensive procedure requiring many steps and many machines. These processes and steps would not be required with the use of the alloys disclosed herein. The use of alloys in their plastic state would be formed in a press or mold or would be stamped. The hollowpoint could be formed by pressing a die into the mold, as in the formation of the hollowpoint in a small arms caliber bullet, or the mold could include a hollowpoint forming element. An incendiary device could be placed in such a cavity without requiring a machining process. An alternative process for the insertion of an incendiary device would be to form fill a jacket with the alloy in its plastic state with the incendiary device in place. It could be placed inside the jacket even easier and would take on the form of the jacket and then be pressed or condensed. The manufacturing of such munitions using a bullet alloy with a plastic state eliminates many of the usual process steps.

These alloys could replace steel in high explosive rounds up to and including 16 inch high explosive projectiles. Such munitions require substantial precision machining which is eliminated in processes permitted with these alloys. In such munitions a steel casing must be formed to accommodate a high explosive packed within the cavity. These alloys would permit such cases to simply be stamped. The material strength of these alloys will accommodate many military applications. The frangible nature of the alloy, when detonated, would meet design requirements for military purposes.

Military applications also include above and below ground explosives, such as a grenades and mines. The frangible nature of these alloys would eliminate the manufacturing of scored cast iron hand grenade cases.

The hollowpoint design is primarily used in ammunition for pistols. The 9 mm Nato design is favored by many nations for military use including the United States, Germany, France, Spain and Italy. Hundreds of millions of rounds are produced every year for military purposes. The majority of military weapons are designed to function with "ball" ammunition. Ball ammunition has a full metal jacket. Hollowpoint ammunition does not function consistently in the military firearm. The reason hollowpoint ammunition does not function consistently in military firearms is a design function of automatic weapons requiring round nose bullets such as that provided by FMJ ball ammunition. Many military firearms are designed to function with a round nose bullet while many weapons destined primarily for civilian use have been manufactured to function with hollowpoint bullets. The Berretta 92 and the Glock will function with round nose or hollowpoint bullets. Weapons utilized by foreign armed forces may function only with FMJ rounds. Conventional hollowpoint designs have relatively large cavity openings and consequently tend to jam on the feed ramp.

The bullet design disclosed herein functions well, producing the intended fragmentation characteristic, with very small hollowpoints and should function the same as a FMJ round in automatic weapon use.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figures 1, 1A, 2, 2A, 3, 4:
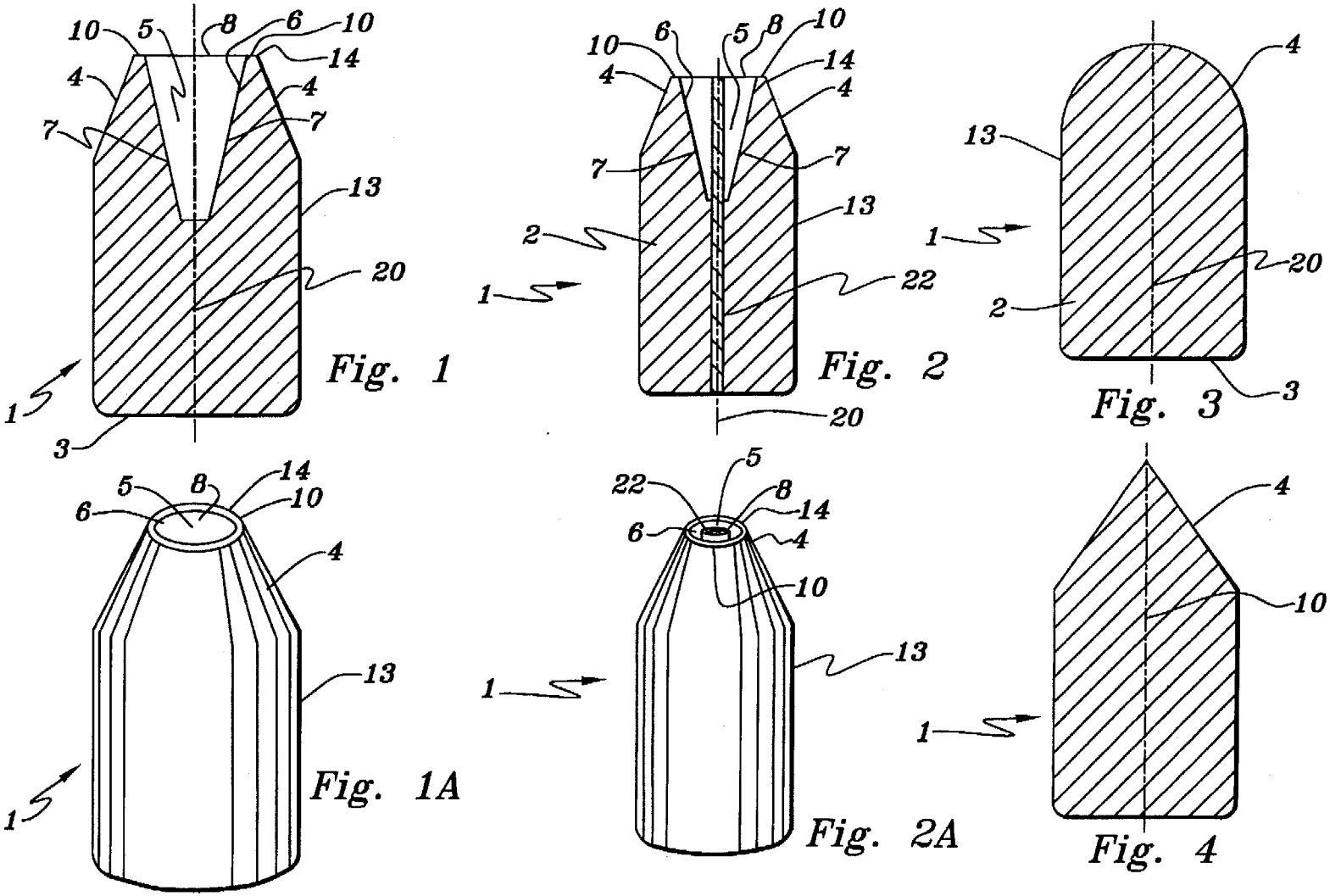
FIG. 1 is a view of a longitudinal cross section of a hollowpoint bullet.
FIG. 1A is a perspective view of a hollowpoint bullet.
FIG. 2 is a view of a longitudinal cross section of a hollowpoint bullet with a hollowpoint cavity and a penetrator or lead post.
FIG. 2A is a view of a perspective view of a hollowpoint bullet with a hollowpoint cavity and a penetrator or lead post.
FIG. 3 is a longitudinal cross section of a round nose solid bullet.
FIG. 4 is a longitudinal cross section of an armor piercing bullet or munitions.

The bullets of FIGS. 1, 1A, 2, 2A, 3, and 4 illustrate the Obstacle Piercing Frangible Bullet 1 disclosed herein and illustrates the preferred embodiment wherein bullets of solid and hollowpoint configurations are formed with cores 2 consisting of alloys from the group mercury, silver, tin, copper, cadmium, bismuth and zinc in percentages by weight, Alloy A—Mercury 40%–60%, Silver 25%–40%, Tin 15%–25%, Copper 0–5% and Zinc 0–2%; Alloy B—Mercury 55%–70%, Cadmium 15%–45%, Tin 0%–25%, Copper 0–2% and Zinc 0–5%; Alloy C—Mercury 55%–65%, Cadmium 10%–30%, Bismuth 10%–30%, Copper 5%–15% and Zinc 0–1%; Alloy D—Mercury 55%–65%, Cadmium 15%–30%, Bismuth 15%–30%, Copper 5%–15% and Zinc 0–1%; Alloy E—Mercury 60%–70%, Cadmium 25%–30%, Copper 5%–10% and Zinc 0–1% and other frangible alloys or metals.

Combinations of elements forming the desired alloy as selected from the group disclosed are mixed at temperatures which will accommodate the manufacturing process to be undertaken and, while in their plastic state, said alloy is injected or otherwise placed into molds, jackets 13 or other containers or are stamped into bullet forms for eventual solid or hollowpoint applications. Bullets whether for solid or hollowpoint applications will have a bullet nose 4 and a bullet base 3. Bullets for use in hollowpoint applications will have a hollowpoint cavity 5 formed, while the alloy is in its plastic state, with a die or other device with the desired profile causing the formation of a hollowpoint cavity 5 with a hollowpoint cavity aperture 8, hollowpoint cavity opening profile 6, hollowpoint cavity profile 7 and hollowpoint lip profile 10 depending on the nature of material piercing and fragmentation characteristic intended. Bullet weight will be determined by the jacket, mold or stamp structure and the volume of the hollowpoint cavity 5.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. An obstacle piercing frangible bullet comprising:

a bullet with a frangible bullet core formed of an alloy composed, by percentages by weight, of the mixture of mercury 40%–60%, silver 25%–40%, tin 15%–25%, copper 0–5% and zinc 0–2%.

2. An obstacle piercing frangible bullet according to claim 1 having:

A. a jacket 13 having a jacket aperture 14; the bullet core 2 received into said jacket 13; said bullet core having a bullet base 3 and a bullet nose 4;

B. a hollowpoint cavity 5 formed in the bullet core 2 commencing at the bullet nose 4 and extending along a bullet core longitudinal axis 20 distal from the bullet nose 4 and toward the bullet base 3; the bullet being cylindrical in shape along the bullet core longitudinal axis 20 and tapering from the bullet base 3 to the bullet nose 4;

C. said hollowpoint cavity 5 having a hollowpoint cavity aperture 8; a hollowpoint lip profile 10 residing between the jacket aperture 14 and the hollowpoint cavity aperture 8; a hollowpoint opening profile 6 defining the shape of the hollowpoint cavity 5 between the hollowpoint lip profile 10 and a hollowpoint cavity profile 7; said hollowpoint cavity profile 7 being that portion of the hollowpoint cavity 5 lying between the hollowpoint opening profile 6 and a base of the hollowpoint.

3. An obstacle piercing frangible bullet according to claim 1 wherein said alloy is composed, by percentages by weight, of a mixture of mercury 50%, silver 26%, tin 23% and copper 1%.

4. An obstacle piercing frangible bullet according to claim 2 having a lead post swaged into the hollowpoint cavity along the hollowpoint cavity longitudinal axis.

5. An obstacle piercing frangible bullet comprising:

a frangible bullet core formed of an alloy composed, by percentages by weight, of the mixture of mercury 55%–70%, cadmium 15%–45%, tin 0%–25%, copper 0–2% and zinc 0–5%.

6. An obstacle piercing frangible bullet according to claim 5 wherein said alloy is composed, by percentages by weight, of a mixture of mercury 66%, cadmium 20%, tin 12.9% and copper 0.1%.

7. An obstacle piercing frangible bullet according to claim 5 having

A. a jacket 13 having a jacket aperture 14; the bullet core 2 received into said jacket 13; said bullet core having a bullet base 3 and a bullet nose 4;

B. a hollowpoint cavity 5 formed in the bullet core 2 commencing at the bullet nose 4 and extending along a bullet core longitudinal axis 20 distal from the bullet nose 4 and toward the bullet base 3; the bullet being cylindrical in shape along the bullet core longitudinal axis 20 and tapering from the bullet base 3 to the bullet nose 4;

C. said hollowpoint cavity 5 having a hollowpoint cavity aperture 8; a hollowpoint lip profile 10 residing between the jacket aperture 14 and the hollowpoint cavity aperture 8; a hollowpoint opening profile 6 defining the shape of the hollowpoint cavity 5 between the hollowpoint lip profile 10 and a hollowpoint cavity profile 7; said hollowpoint cavity profile 7 being that portion of the hollowpoint cavity 5 lying between the hollowpoint opening profile 6 and a base of the hollowpoint.

* * * * *